United States Patent [19]

Marzoli

[11] 4,040,146

[45] Aug. 9, 1977

[54] DEVICE FOR DISTRIBUTING TEXTILE FIBER SLIVERS INSIDE COLLECTION BOXES IN SPINNING PREPARATION MACHINES

[75] Inventor: Angelo Marzoli, Bergamo, Italy

[73] Assignee: F. lli Marzoli & C. S.p.A., Palazzolo Sull'Oglippo, Italy

[21] Appl. No.: 660,314

[22] Filed: Feb. 23, 1976

[30] Foreign Application Priority Data

Feb. 27, 1975 Italy ..... 20727/75

[51] Int. Cl.[2] ..... B65H 54/80

[52] U.S. Cl. ..... 19/159 R

[58] Field of Search ..... 19/157, 159 R, 159 A; 100/82; 242/82

[56] References Cited

U.S. PATENT DOCUMENTS

| | | | |
|---|---|---|---|
| 3,169,279 | 2/1965 | Noda | 19/159 R |
| 3,324,515 | 6/1967 | West | 19/159 R |

FOREIGN PATENT DOCUMENTS

| | | | |
|---|---|---|---|
| 1,209,030 | 1/1966 | Germany | 19/159 R |
| 1,115,623 | 10/1961 | Germany | 19/159 R |

*Primary Examiner*—Dorsey Newton

[57] ABSTRACT

This invention relates to a device for distributing textile fiber slivers inside collection boxes in spinning preparation machines, in particular in drawing frames. The device according to the invention comprises a plate rotating above the collection box and containing an eccentric outlet connected by a duct fixed to the plate to a substantially axial inlet which faces guide calendars for a sliver leaving a spinning preparation machine; the duct is formed by two tubular portions, which are partially inserted in one another and form a cylindrical passage external to the portion defining the duct inlet. In this manner the sliver is guided delicately by a cushion of air centrifuged towards the duct outlet and the friction due to rubbing of the sliver on the duct in proximity of the duct outlet is reduced to a minimum.

4 Claims, 3 Drawing Figures

DEVICE FOR DISTRIBUTING TEXTILE FIBER SLIVERS INSIDE COLLECTION BOXES IN SPINNING PREPARATION MACHINES

This invention relates to a device for distributing textile fibre slivers inside collection boxes in spinning preparation machines, in particular in drawing frames.

After a textile fibre sliver has been processed in a carding machine, combing machine or drawing frame etc., it is notably collected inside boxes so that the product may be transferred to other machines for its further processing. The sliver is distributed inside the box by a rotating plate disposed above this latter and carrying an eccentric duct which extends axially in proximity to sliver guide calenders downstream of the machine. Thus the sliver, which leaves the machine with a determined speed of movement, is also made to rotate by passing through the plate duct. The rotational speed of the plate required for depositing the sliver inside the box in a determined regular configuration is in fact governed by the speed of movement of the sliver.

As the sliver outlet speed in modern machines, in particular in drawing frames, reaches considerable values and the box cannot be made larger than certain standardised dimensions, the plate diameter and therefore the radius of eccentricity of the exit of the sliver from the plate is contained within predetermined values. As only boxes of determined dimensions are available, the speed of sliver distribution can only be increased by increasing the angular velocity of the plate.

In rotating sliver distribution plates of known type, there is therefore the problem of the strength of the sliver being weakened at the plate outlet, as the increase in angular velocity of this latter leads to an increase in the rubbing of the sliver on the duct, especially at its outlet. The movement of the sliver is checked and the danger arises of blockage in the duct. The method used for guiding the sliver so that it becomes disposed without damage inside the box is therefore of primary importance when the sliver is travelling at high speed.

The plate angular velocity must always be chosen in relation to the speed of sliver movement so that the sliver enters the box without damage due to stretching or to excessive compression of the reel formed in it. The object of the invention is to avoid the aforementioned dangers which a sliver encounters during its collection, and to ensure reliable delicate guiding of the sliver as it passes through the distribution device, with minimum friction due to rubbing between the sliver and the device.

These and further objects are attained according to the invention by a distribution device of the type heretofore described, wherein a plate rotating above a collection box comprises an eccentric outlet connected by a duct fixed to the plate, to a substantially axial inlet which faces guide calenders for a sliver leaving a spinning preparation machine, the duct being formed from two tubular portions, one partially inserted in the other, and forming an annular cylindrical passage external to the portion defining the inlet.

In this manner the sliver is guided delicately by a cushion of air centrifuged towards the duct outlet from the duct inlet. The friction due to rubbing of the sliver on the duct in proximity to its outlet is reduced to a minimum as there is practically no direct mutual contact.

The structural characteristics and advantages of the distribution device according to the invention will be more evident from the description given hereinafter of those embodiments shown in the figures of the accompanying drawing.

Figure 1:
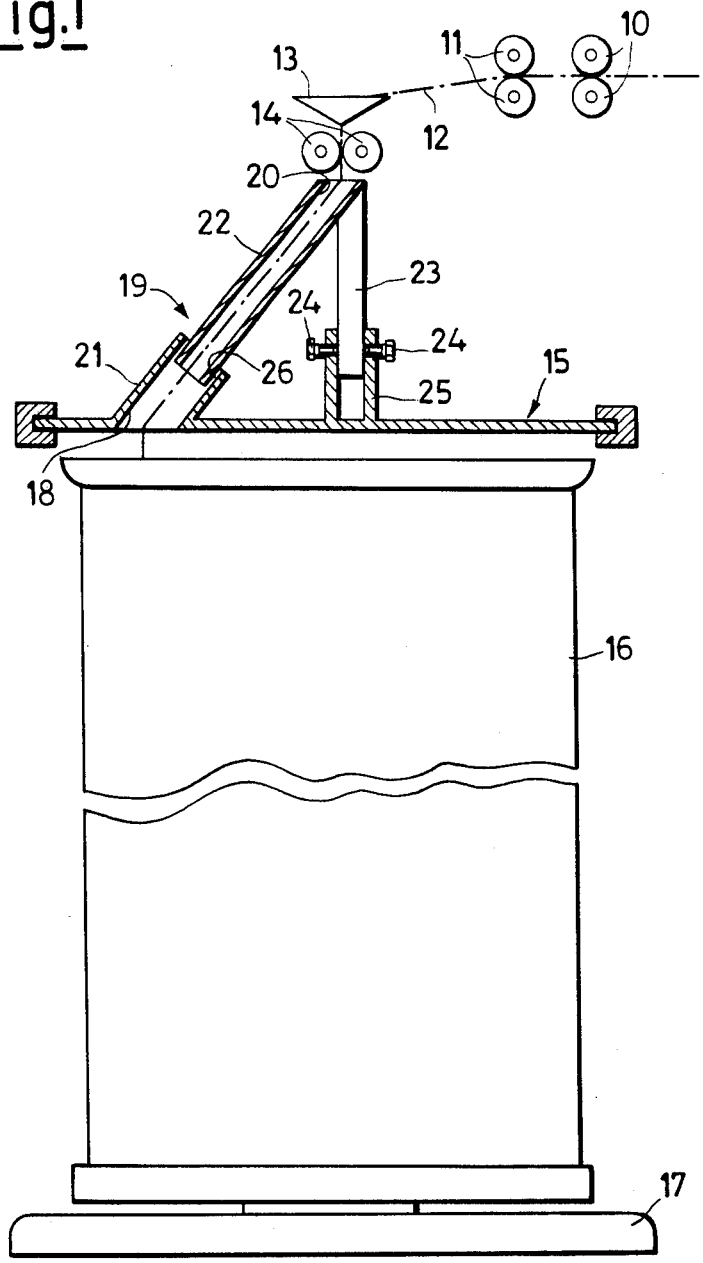
FIG. 1 is a partially sectional view of a collection arrangement incorporating a first embodiment of the device according to the invention, provided downstream of a drawing frame.

With reference to FIG. 1, an exit sliver is guided at the outlet of a drawing frame, indicated diagrammatically by pairs of drawing cylinders 10 and 11, so that it traverses a conveying funnel 13, known as a condenser, a pair of calenders 14 and a rotating plate 15, commonly known as a coiler, which distributes the sliver 12 inside a collection box 16. This is mounted on a turntable 17, which may rotate in one direction, in alternate directions or remain at rest. Neither the drives for the plate 15 or turntable 17, nor the individual components of the structure on which they are mounted are shown. These are particularly known and do not require explanation for the understanding of the invention.

To enable the sliver 12 to be guided through the plate 15, this latter is provided with an eccentric outlet 18 connected by a duct, indicated overall by 19, to an inlet 20 facing the calenders 14. The duct 19 is formed from a tubular portion 21 and a tubular portion 22. The tubular portion 21 is of greater diameter and is fixed to the plate 15 at the outlet 18. The tubular portion 22 is of smaller diameter and is supported by an axial rod 23 at the inlet 20. The rod is fixed by screws 24 into a central sleeve 25 rigid with the plate 15.

The portions 21 and 22 are partially inserted into each other and form an annular cylindrical passage 26.

Figure 2:
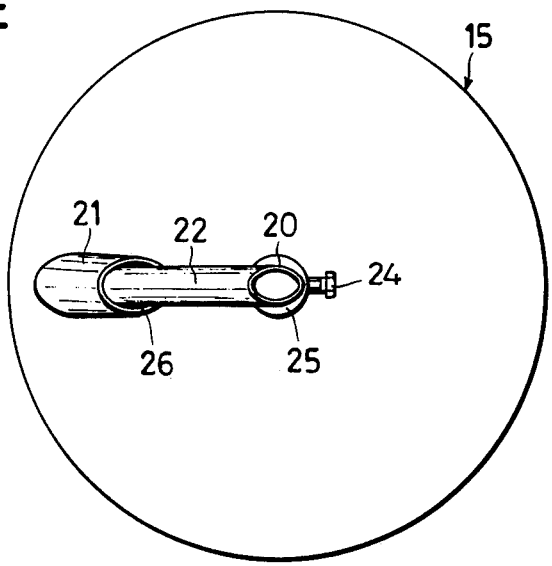
FIG. 2 is a view from above of the distribution plate of FIG. 1.

FIG. 2 shows clearly that the portions 21 and 22 of the duct 19 have a common inclined straight axis lying in a vertical plane which also includes the axis of rotation of the plate itself.

Figure 3:
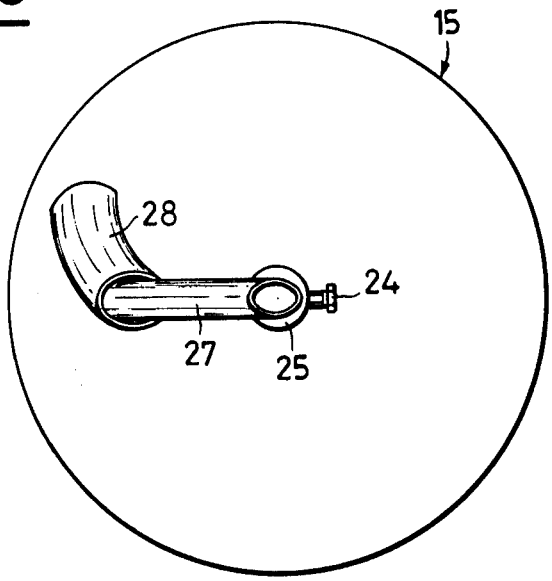
FIG. 3 is a view from above of a second embodiment of the distribution plate according to the invention.

In certain cases, such as when the sliver speed is very high, the version shown in FIG. 3 may be advantageous. In it, the axis of the tubular portion 27 is straight and inclined, while the axis of the portion 28 is curved and skew with respect to the axis of rotation of the plate 15.

The operation of the distribution device according to the invention is as follows.

It will be assumed that the plate 15 rotates in an anticlockwise direction and the box in a clockwise direction. The sliver 12 leaving the portion 22 encounters a flow of air through the passage 26 generated by the centrifugal effect induced by the rotation of the plate 15. This air jacket accompanies the sliver 12 until it reaches the outlet 18, where it leaves together with the sliver 12, so substantially limiting any direct sliding contact between the plate and sliver. The sliver 12 is therefore distributed very easily and with very little friction to check the speed of movement of the sliver or damage it.

The optimum position for the passage 26 may be chosen by adjusting the rod 23, which is fixed by screws 27 to the sleeve 25.

It is evident that various duct configurations are possible within the scope of the invention, both with regard to the shape of its cross-section and to the path of its axis. The cross-section could be elliptical instead of circular, and the duct could consist of two straight portions variously inclined to each other, a straight portion combined with a curve, two curves of different curvature, a spiral portion etc.

What we claim is:

1. Device for distributing textile fiber slivers inside collection boxes in spinning preparation machines, in particular at the outlet of drawing frames, comprising a plate rotating above a collection box, an eccentric outlet on said plate, a duct fixed to said plate, said duct having a substantially axial inlet and an eccentric outlet, and guide calenders, said eccentric outlet being connected by said duct to said axial inlet facing said guide calenders for the sliver leaving the machine, said duct comprising two tubular portions, one portion being partially inserted in the other, one portion defining the duct inlet, said tubular portions forming an annular passage external to the portion defining the duct inlet, said annular passage being formed between said tubular duct portions and communicating with the atmosphere at one end and with the eccentric outlet of the duct at the other end; an axial rod fixable to said plate and having a free end, means for adjusting the spacing of the free end of the axial rod from said plate, the inlet portion of the duct being supported at said inlet by said axial rod fixable to said plate, the height of said inlet portion being adjustable by said adjusting means.

2. Device as claimed in claim 1, wherein the two portions have a common straight axis.

3. Device as claimed in claim 1, wherein the axis of the portion comprising the duct outlet is skew in relation to the plate rotational axis.

4. Device for distributing textile fiber slivers inside collection boxes in spinning preparation machines, in particular at the outlet of drawing frames, comprising a plate rotating above a collection box, an eccentric outlet on said plate, a duct fixed to said plate, said duct having a substantially axial inlet and an eccentric outlet, and guide calenders, said eccentric outlet being connected by said duct to said axial inlet facing said guide calenders for the sliver leaving the machine, said duct comprising two tubular portions, one portion being partially inserted in the other, one portion defining the duct inlet, said tubular portions forming an annular passage external to the portion defining the duct inlet, said annular passage being formed between said tubular duct portions and communicating with the atmosphere at one end and with the eccentric outlet of the duct at the other end; an axial rod fixable to said plate and having a free end, means for adjusting the spacing of the free end of the axial rod from said plate, the inlet portion of the duct being supported at said inlet by said axial rod fixable to said plate, the height of said inlet portion being adjustable by said adjusting means, said two portions having a common straight access.

* * * * *

UNITED STATES PATENT AND TRADEMARK OFFICE

CERTIFICATE OF CORRECTION

PATENT NO. : 4,040,146

DATED : August 9, 1977

INVENTOR(S) : MARZOLI

It is certified that error appears in the above-identified patent and that said Letters Patent are hereby corrected as shown below:

Change the assignee's address from "F. LLI MARZOLI & C. S.p.A., Palazzolo sull'Oglippo (Brescia)" to --F. LLI MARZOLI & C. S.p.A., Palazzolo sull'Oglio (Brescia - Italy)--.

Signed and Sealed this

*Twenty-first* Day of *February 1978*

[SEAL]

*Attest:*

RUTH C. MASON
*Attesting Officer*

LUTRELLE F. PARKER
*Acting Commissioner of Patents and Trademarks*